United States Patent [19]

Jonas et al.

[11] Patent Number: 4,734,220

[45] Date of Patent: Mar. 29, 1988

[54] FUSIBLE ELECTROCONDUCTIVE MIXTURES

[75] Inventors: Friedrich Jonas, Aachen; Rolf Dhein, Krefeld, both of Fed. Rep. of Germany

[73] Assignee: Bayer Aktiengesellschaft, Leverkusen, Fed. Rep. of Germany

[21] Appl. No:: 16,597

[22] Filed: Feb. 19, 1987

[30] Foreign Application Priority Data

Mar. 8, 1986 [DE] Fed. Rep. of Germany ..... 3607668

[51] Int. Cl.[4] ..... H01B 1/06

[52] U.S. Cl. ..... 252/500

[58] Field of Search ..... 252/500; 524/236

[56] References Cited

U.S. PATENT DOCUMENTS

| | | | |
|---|---|---|---|
| 3,424,698 | 1/1969 | Lupinski et al. | 252/500 |
| 4,478,751 | 10/1984 | Jonas et al. | 252/500 |
| 4,500,459 | 2/1985 | Holta et al. | 252/500 |
| 4,529,538 | 7/1985 | Kim | 524/236 |
| 4,568,485 | 2/1986 | Jonas et al. | 252/500 |
| 4,568,494 | 2/1986 | Jonas et al. | 252/500 |
| 4,622,266 | 11/1986 | Kim | 524/236 |
| 4,663,078 | 5/1987 | Jonas et al. | 252/500 |

*Primary Examiner*—Josephine Barr

*Attorney, Agent, or Firm*—Sprung Horn Kramer & Woods

[57] ABSTRACT

The invention concerns fusible mixtures of high electroconductivity which consist of (a) 0.5 to 99% by weight, relative to the total weight of the mixture, of a TCNQ complex of the formula

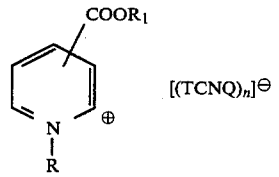

(I)

in which

R and $R_1$ independently of each other stand for an optionally substituted aliphatic, cycloaliphatic or araliphatic radical having 1 to 30 C atoms and n is 1, 2 or 3 or a fraction between these numbers and (b) 99.5 to 1% by weight, relative to the total weight of the mixture, of one or more special liquid organic compounds.

3 Claims, No Drawings

FUSIBLE ELECTROCONDUCTIVE MIXTURES

The invention relates to new fusible electroconductive mixtures of improved conductivity and processability.

Complex salts of 7,7,8,8-tetracyano-p-quinodimethane anion $(TCNQ)^-$,

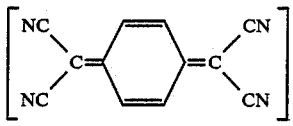

neutral 7,7,8,8-tetracyano-p-quinodimethane (TCNQ) and inorganic or organic cations are known as electroconductive compounds.

It is further known that the processing of these complexes presents problems at temperatures above their melting point, since their melting point and decomposition temperature are too close together. It is true that DE-OS (German Published Specification) No. 3,214,355 describes specific TCNQ complexes which can be briefly heated to temperatures above their melting point without loss of their electroconductivity. But even with these complexes the time for which they are heatable to the melting point without decomposition is too short for many processing methods. In addition, their melting points and hence the temperatures required for their processing are unfavourably high.

It has therefore been proposed to improve the thermostability of TCNQ complex salts by adding various other substances, for example polyhydric alcohols and/or metal powders (see JA-A-No. 85/212904, JA-A-No. 85/212902, JA-A-No. 85/212903), solid paraffins (see JA-A-No. 85/257 005), sugars (see JA-A-No. 85/257 006) or phenols (see JA-A-No. 85/212 901). EP-A No. 2-0,152,082 proposes increasing the thermostability of specific TCNQ complexes, namely of the propylisoquinolinium TCNQ complex, by mixing with certain lactones, for example γ-butyrolactone.

It is true that these known mixtures of TCNQ complex salts and additives have lower melting points than their parent TCNQ complex salts and therefore permit lower processing temperatures and likewise withstand somewhat longer processing times. Nonetheless their processing properties and in particular the conductivity of the solidified melts of these mixtures are still unsatisfactory.

It has now been found that solidified melts of TCNQ complexes having a conductivity which is higher by at least one order of magnitude, coupled with approximately doubled processing times, are obtained when certain N-substituted pyridinium-TCNQ complexes are mixed with certain monomolecular liquid organic compounds. These mixtures are distinguished from the known TCNQ complex salts and mixtures thereof with other compounds by a significantly increased conductivity and, as a consequence of the likewise significantly increased thermostability, also by a significantly improved processability.

The invention therefore relates to fusible mixtures of high electroconductivity which consist of (a) 0.5 to 99% by weight, relative to the total weight of the mixture, of a TCNQ complex of the formula

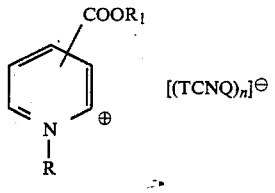

(I)

in which

R and $R_1$ independently of each other stand for an optionally substituted aliphatic, cycloaliphatic or araliphatic radical having 1 to 30 C atoms and n is 1, 2 or 3 or a fraction between these numbers and (b) 99.5 to 1% by weight, relative to the total weight of the mixture, of one or more of the following liquid organic compounds: N-methylpyrrolidone, N-methylcaprolactam, γ-butyrolactone, caprolactone, dipentyl ether, diethylene glycol dimethyl ether, triethylene glycol dimethyl ether, 1,4,7,10,13-pentaoxacyclopentadecane, 1,4,7,10-tetraoxacyclododecane, dimethyl sulphoxide, diethyl sulphoxide, tetramethylene sulphone, tetramethylurea and/or propylene carbonate.

The liquid organic compounds to be used as stability and processability-improving additives can be used in the pure form or in the form of mixtures. Of particular suitability are N-methylpyrrolidone, N-methylcaprolactam, γ-butyrolactone, caprolactone, tetramethylene sulphone and/or propylene carbonate.

Preference is given to using in the mixtures according to the invention the TCNQ complex salts of the formula I in which the $—COOR_1$ group is in the 4-position.

The mixtures according to the invention preferably contain 30 to 80% by weight of the stated TCNQ complex of the formula (I) and 70 to 20% by weight of the stated liquid-organic compounds.

The TCNQ complex salts of the formula (I) are obtained by the reactions known for the preparation of TCNQ complex salts and described for example in J. Am. Chem. Soc. 84, page 3374 to 3387 (1962), for example by reacting 4 moles of 7,7,8,8-tetracyano-p-quinodimethane (TCNQ) with 3 moles of the corresponding pyridinium iodide.

The preparation of the TCNQ complex salts of the formula (I) is advantageously effected by reacting solutions of alkoxycarbonyl-substituted pyridinium iodides with a solution of TCNQ in organic solvents at temperatures below 150° C.

Suitable organic solvents are for example halohydrocarbons such as methylene chloride, chloroform, carbon tetrachloride, 1,2-dichloroethane, 1,1,2-trichloroethane; acetonitrile; alcohols, such as methanol, ethanol and isopropanol; aliphatic ketones such as acetone and methyl ethyl ketone; acyclic and cyclic ethers such as diethyl ether and tetrahydrofuran.

The reactants are used in a ratio of 1 mole of TCNQ:0.5 to 1 mole of pyridinium iodide.

The mixtures according to the invention can be prepared by mixing the individual constituents by known methods, for example by milling, grinding etc.

The conductivity of the mixtures can be varied within wide limits by changing the ratio of TCNQ complex to organic compound. The mixtures can be maintained in melt form for at least 1 minute without losing any electrical properties. Even repeated melting of the mixtures is possible.

The mixtures according to the invention can be mixed for their use with other substances, for example with polymeric binders, stabilizers, pigments and the like.

Owing to their favourable melting and decomposition behaviour, the mixtures according to the invention can be used for preparing electroconductive coatings on substrates by melting-on.

Suitable substrates which may be mentioned are: glass, metals, metal oxides, organic polymers. Substrates of this type can be coated by applying melts of the mixtures according to the invention to preheated substrates. The mixtures according to the invention can also be applied to the substrates to be coated at room temperature and subsequently be melted on in a preheated oven. The two processes lead to firmly adhering electroconductive coatings.

The coatings thus prepared can be used in electrical engineering and in electronics.

EXAMPLE 1

X g of TCNQ complex salt of the formula stated below and Y g of the compound B are carefully mixed with each other by grinding in a mortar. The mixture is subsequently heated for z minutes in a glass test tube in a metal bath at temperature T. The highly mobile melts formed in the course of the heating are rapidly cooled down to a temperature below the melting point (solidification temperature) of the mixtures after expiration of the time Z. After cooling down the melts to room temperature, their resistance is determined by the four electrode method.

TCNQ complex used:

TCNQ complex used:

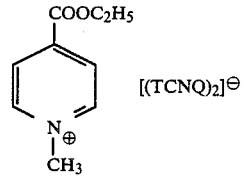

Table 1 below shows the compounds B, the amounts Y in which the compounds B were used in the mixtures, the temperature T of the metal bath, the time Z for which these mixtures were heated in the metal bath at temperature T, and the electrical resistance R of the solidified melts of these mixtures.

TABLE 1

| Example 1 | X [g] | Y [g] | B | Z [min] | T [°C.] | R [Ω] |
|---|---|---|---|---|---|---|
| a | 1 | — | (comparison) | — | — | 2 |
| b | 1 | — | " | 1 | 240 | 3.5 |
| c | 1 | — | " | 2 | 240 | ∞ |
| d | 1 | 0.2 | propylene carbonate | 2 | 220 | 2.5 |
| e | 1 | 0.5 | propylene carbonate | 2 | 200 | 4.0 |
| f | 1 | 0.2 | NMC* | 2 | 200 | 3.5 |
| g | 1 | 0.5 | " | 2 | 200 | 7.0 |
| h | 1 | 0.75 | " | 3 | 180 | 8.0 |
| i | 1 | 0.2 | NMC/NMP** 1:1 | 1.5 | 200 | 7.0 |
| k | 1 | 0.5 | " | 2 | 200 | 10.0 |

*NMC = N—methylcaprolactam
**NMP = N—methylpyrrolidone

The data indicated in the table show that the mixtures according to the invention have lower melting points, an increased stability at high temperature and good conductivities compared with the undiluted TCNQ complex salt even after melting and resolidification.

EXAMPLE 2

The mixture of 1.0 g of TCNQ complex salt and 0.5 g of N-methylcaprolactam, described in Example 1 g, is applied in a 0.5 mm thick layer to a 1 cm wide glass slide. The mixture is made to melt by heating the slide to 200° C., is maintained at the melting point for 2 minutes and is then cooled down to a temperature below the melting point in the course of about 10 seconds. Thereafter the electrical resistance of the layer is generally in accordance with $R_{OB}$ (DIN 53,482). Resistance of the layer was 5 Ω.

If the glass slide is coated with the undiluted TCNQ complex salt, melting requires a temperature of 240° C. After heating at 240° C. for 2 minutes and subsequent cooling down, the resistance of the layer is 50 Ω.

EXAMPLE 3

(COMPARATIVE EXPERIMENT)

The following mixtures were prepared by careful grinding of the following components:

| Designation of mixture | TCNQ complex used | Additive | Amount [g]/g of TCNQ complexes |
|---|---|---|---|
| | A | — | — |
| A1 | A | γ-butyrolactone | 0.5 |
| A2 | A | γ-butyrolactone | 0.2 |
| A3 | A | sulpholane | 0.5 |
| A4 | A | sulpholane | 0.2 |
| | B | — | — |
| B1 | B | γ-butyrolactone | 0.5 |
| B2 | B | γ-butyrolactone | 0.2 |
| B3 | B | sulpholane | 0.5 |
| B4 | B | sulpholane | 0.2 |

TCNQ complex A and mixtures A1 to A4 in accordance with EP-A No. 2-0, 152,082;

TCNQ complex B and mixtures B1 to B4 according to the invention.

TCNQ complex A:

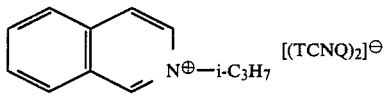

TCNQ complex B:

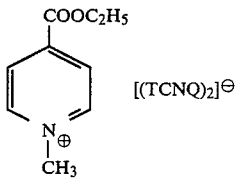

The mixtures were heated in a glass test tube in a metal bath which has a temperature of 220° C. until the onset of decompostition. The times t were determined for which the individual mixtures can be heated at 220° C. until the onset of decomposition. In addition, mixtures which had been heated at 220° C. for 1 minute and subsequently been cooled back down to room temperature were measured for electrical resistance R.

Table 3 below shows the times t and electrical resistances R determined for the individual mixtures and their parent TCNQ complex salts.

TABLE 3

| Mixtures or TCNQ complexes | t [sec] | R [Ω] at RT |
|---|---|---|
| A | 70* | 100 |
| A1 | 160 | 120 |
| A2 | 109 | 80 |
| A3 | 130 | 100 |
| A4 | 100 | 80 |
| B | 40** | — |
| B1 | 220 | 39 |
| B2 | 185 | 80 |
| B3 | 141 | 22 |
| B4 | 205 | 14 |

*Melting point: 240° C.
**Melting point: 230° C.

A comparison of the decomposition times t obtained for the various mixtures and of the electrical resistances R of the briefly heated and resolidified melts of the mixtures shows that, for the same additives such as γ-butyrolactone and sulpholane, a different increase in the thermostability is obtained for the different TCNQ complex salts. The comparative experiments reveal that the thermostability of pyridinium-TCNQ complex salt is disproportionately more markedly increased by the additives than that of the isoquinolinium-TCNQ complex salt.

What is claimed is:

1. A fusible mixture of high electroconductivity consisting of (a) 0.5 to 99% by weight, relative to the total weight of the mixture, of a TCNQ complex of the formula

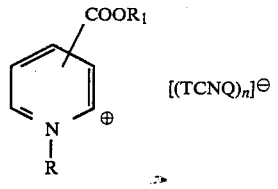

(I)

in which

R and $R_1$ independently of each other stand for an optionally substituted aliphatic, cycloaliphatic or araliphatic radical having 1 to 30 C atoms and n is 1, 2 or 3 or any fraction between these numbers and (b) 99.5 to 1% by weight, relative to the total weight of the mixture of one or more of the following liquid organic compounds: N-methylpyrrolidone, N-methylcaprolactam, γ-butyrolactone, caprolactone, dipentyl ether, diethylene glycol dimethyl ether, triethylene glycol dimethyl ether, 1,4,7,10,13-pentaoxacyclopentadecane, 1,4,7,10-tetraoxacyclododecane, dimethyl sulphoxide, diethyl sulphoxide, tetramethylene sulphone tetramethylurea and/or propylene carbonate.

2. The fusible mixture of claim 1, wherein the amount of component (a) is 30 to 80% by weight and the amount of component (b) is 70 to 20% .

3. The fusible mixture of claim 1, wherein the liquid organic compound is N-methylpyrrolidone, N-methylcaprolactam, γ-butyrolactone, caprolactone, tetramethylene sulphone, propylene carbonate and/or a mixture of these stated compounds.

* * * * *